US007242359B2

(12) United States Patent
Turner et al.

(10) Patent No.: US 7,242,359 B2
(45) Date of Patent: Jul. 10, 2007

(54) PARALLEL LOOP ANTENNAS FOR A MOBILE ELECTRONIC DEVICE

(75) Inventors: James Benjamin Turner, Monroe, WA (US); Jason Lane Williams, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 117 days.

(21) Appl. No.: 10/920,872

(22) Filed: Aug. 18, 2004

(65) Prior Publication Data

US 2006/0038731 A1 Feb. 23, 2006

(51) Int. Cl.
*H01Q 11/12* (2006.01)
*H01Q 21/00* (2006.01)

(52) U.S. Cl. ..... 343/742; 343/855; 343/867

(58) Field of Classification Search ..... 343/742, 343/788, 895, 855, 867
See application file for complete search history.

(56) References Cited

U.S. PATENT DOCUMENTS

| | | | | |
|---|---|---|---|---|
| 2,354,332 A | | 7/1944 | Polydoroff | 250/33 |
| 4,622,558 A | * | 11/1986 | Corum | 343/742 |
| 4,751,515 A | | 6/1988 | Corum | 343/742 |
| 5,159,332 A | * | 10/1992 | Walton | 340/10.3 |
| 5,337,061 A | | 8/1994 | Pye et al. | 343/702 |
| 5,442,369 A | * | 8/1995 | Van Voorhies et al. | 343/742 |
| 5,451,965 A | | 9/1995 | Matsumoto | 343/702 |
| 6,384,696 B1 | * | 5/2002 | Miller et al. | 333/132 |
| 6,697,025 B2 | | 2/2004 | Koyanagi et al. | 343/741 |
| 2001/0000960 A1 | | 5/2001 | Dettioff | 343/748 |
| 2003/0119469 A1 | | 6/2003 | Karr et al. | 455/307 |
| 2004/0203377 A1 | * | 10/2004 | Eaton et al. | 455/41.2 |

FOREIGN PATENT DOCUMENTS

| | | |
|---|---|---|
| DE | 40 26 852 A1 | 2/1991 |
| EP | 1 416 585 A1 | 5/2004 |
| JP | 03270403 | 12/1991 |

* cited by examiner

*Primary Examiner*—Shih-Chao Chen
(74) *Attorney, Agent, or Firm*—Merchant & Gould P.C.

(57) ABSTRACT

A mobile electronic device, such as a smart personal object includes an antenna system for emitting and receiving signals. The antenna system includes at least two antennas electrically connected in parallel to define an equivalent circuit having a reduced inductance with a substantially unaffected induced voltage for the equivalent circuit.

19 Claims, 11 Drawing Sheets

$$Zo = \frac{1}{[1/(SL+R)] + [1/(SL+R)]}$$

$$Zo = \frac{1}{2*[1/(SL+R)]} = \frac{(SL+R)}{2}$$

$$Zo = S*(L/2)+R/2$$

PARALLEL LOOP ANTENNAS FOR A MOBILE ELECTRONIC DEVICE

FIELD OF THE INVENTION

The present invention relates generally to mobile electronic devices. More particularly, the present invention relates to an antenna system for a mobile electronic device.

BACKGROUND OF THE INVENTION

As society becomes increasingly mobile, mobile electronic devices are enjoying a tidal wave of popularity and growth. Cell phones, wireless PDAs, wireless laptops and other mobile communication devices are making impressive inroads with mainstream customers. Constraining this growth and limiting customer satisfaction, however, is the lack of a truly adequate high-coverage-area, inexpensive, small, battery-efficient wireless communication system. Cellular data-transmit telephony-based solutions are far from power-efficient, and impose (relative) cost and size burdens that make them unusable.

A range of new technologies including low-distraction user interfaces, a new operating system platform, and new communications capabilities are being developed. Smart Personal Objects are everyday objects, such as clocks, pens, key-chains and billfolds, that are made smarter, more personalized and more useful through the use of special software. These everyday objects already exist in huge numbers, and, of course, all of them already have primary functions that people find valuable. They could also be extended to display not just time, but timely information—traffic information, schedule updates, news—anything that is time-critical and useful to people.

The ability of these objects to receive and utilize the information is partially dependent upon the signal receiving and transmitting capability of each object. For some applications, it is desirable to utilize some part of the FM frequency band to transmit information. However, potential problems can thwart the efficient utilization of the FM signals. For example, the inductance amount of some FM and higher frequency rod antennas (besides ferrite loss) tends to increase dramatically. The increased inductance usually necessitates a reduced capacitance. However, printed wire board (PWB) traces (or printed circuit board (PCB) traces) and integrated circuit (IC) packages, and receiver IC have capacitance that set the minimum capacitance achievable for a tank circuit. IC inputs are typically high impedance and the use of matching circuits tends to involve more loss. Matching circuits tend to include stray capacitance as well. Moreover, using any type of micro-strip matching is undesirable because of the very long wavelengths relative to the PWB dimensions of portable devices. Thus, a more robust antenna system is desirable for a mobile electronic device.

SUMMARY OF THE INVENTION

In a low-power, portable computer, the invention utilizes at least two antennas connected in parallel for receiving information from a source. According to one embodiment of the invention, an antenna system includes at least two plural loop antennas for improving reception of frequency modulated (FM) signals. The antenna system includes two antennas wired in parallel with one another in the antenna circuit, resulting in an equivalent circuit having a reduced inductance without substantially affecting the induced voltage for the equivalent circuit. The antenna system allows higher inductance and radiation resistance for each antenna in the system, while allowing manageable capacitance values for antenna tuning. The present invention allows smart personal object technology devices and other high frequency (HF) (3–30 MHz (wavelength: 100 m–10 m)), very-high frequency (VHF) (30–300 MHz (wavelength: 10 m–1 m)), and ultra-high frequency (UHF) (300–3000 MHz (wavelength: 1 m–10 cm)) devices to have improved sensitivity and configuration flexibility.

A more complete appreciation of the present invention and its improvements can be obtained by reference to the accompanying drawings, which are briefly summarized below, to the following detailed description of illustrative embodiments of the invention, and to the appended claims.

DETAILED DESCRIPTION OF THE PREFERRED EMBODIMENT

Figure 1:
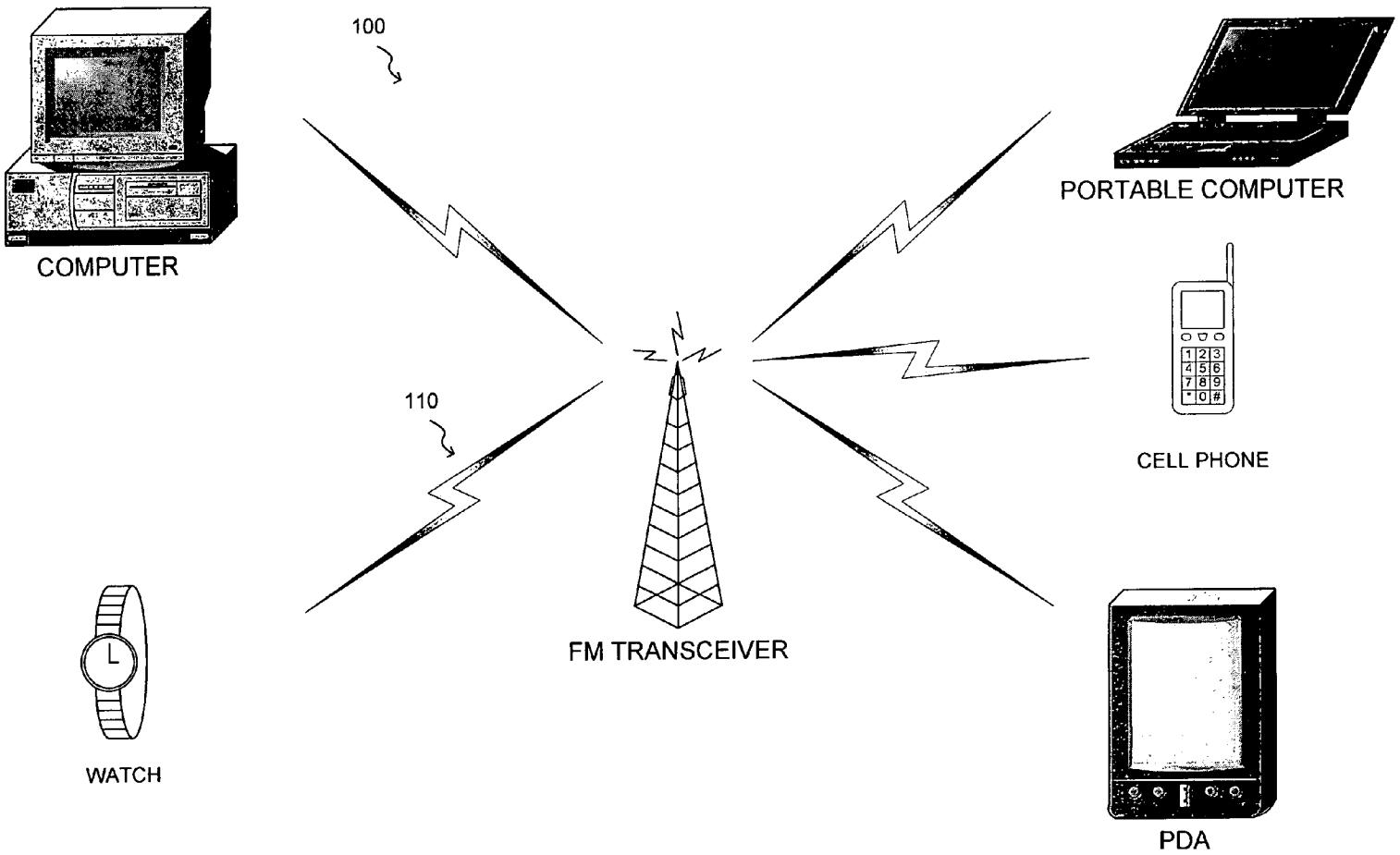
FIG. 1 is a diagram illustrating an operating environment.

The present invention is described in the context of wireless client devices, such as personal data assistants (PDAs), cellphones, pagers, smart phones, camera phones, etc. In the preferred embodiment, the client device is a watch type device, specially configured to receive communication signals.

The present invention provides an antenna system for an electronic device. More particularly, the present invention provides an antenna system for a mobile electronic device for improving reception of high, very-high, and ultra-high frequency signals by the device. According to a preferred embodiment, the antenna system includes first and second antennas wired in parallel with one another in the antenna circuit. The parallel antenna structure results in an equivalent circuit having a reduced inductance without substantially affecting the induced voltage for the equivalent circuit. The antenna system tends to allow higher inductance and radiation resistance for each antenna, while allowing manageable capacitance values for antenna tuning.

As described below, the electronic devices may be smart watch type devices that are specially configured to receive and/or transmit communication signals. Although certain embodiments are described in the context of a watch-based system, it will be apparent that the teachings of the application have equal applicability to other mobile devices, such as portable computers, personal digital assistants (PDAs), cellular telephones, alarm clocks, key-chains, refrigerator magnets, and the like. The use of a watch is for illustrative purposes only to simplify the following discussion, and may be used interchangeably with "mobile device", and/or "client device".

"Computer readable media" can be any available media that can be accessed by client/server devices. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by client/server devices.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above are included within the scope of computer readable media.

The term "content" can be any information that may be stored in an electronic device. By way of example, and not limitation, content may comprise graphical information, textual information, and any combination of graphical and textual information. Content may be displayable information or auditory information. Auditory information may comprise a single sound or a stream of sounds.

The overall operating environment for the present invention will be discussed as follows below with reference to FIGS. 1–2.

Operating Environment

FIG. 1 illustrates an example operating environment 100 for the present invention. As illustrated in the figure, an FM transceiver or broadcast is transmitted over a communication channel 110 to various electronic devices. Example electronic devices that have an FM receiver or transceiver may include a desktop computer, a watch, a portable computer, a wireless cellular telephone (cell phone), and/or a personal data assistant (PDA). The electronic devices are arranged to receive information from the FM broadcast. The FM broadcast may be of any number of types including but not limited to: a standard FM transmission, a sub-carrier FM transmission, or any other type of FM transmission as may be desired.

Example electronic devices that may include an electronic system that is arranged to operate according to the interaction model are illustrated in FIG. 1. The electronic system may employ a wireless interface such as the FM transmission systems that are described above. Each of the electronic systems receives messages/information over the communication channel.

The operating environment shown and described are only examples of suitable operating environments and are not intended to suggest any limitation as to the scope of use or functionality of the invention. Other well known computing systems, environments, and/or configurations that may be suitable for use with the invention include, but are not limited to, personal computers, server computers, hand-held or laptop devices, multiprocessor systems, microprocessor-based systems, programmable consumer electronics, network PCs, minicomputers, mainframe computers, distributed computing environments that include any of the above systems or devices, and the like.

Illustrative Electronic System

Figure 2:
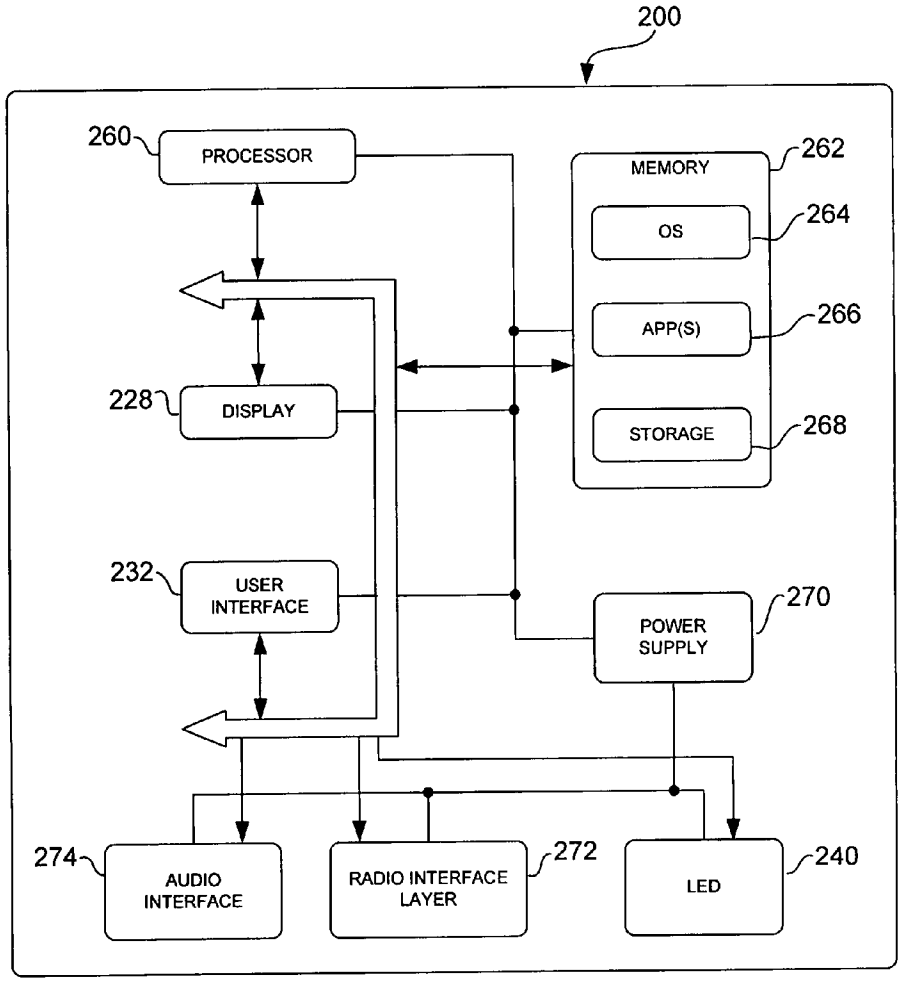
FIG. 2 is a schematic diagram illustrating an electronic device.

FIG. 2 is a schematic diagram illustrating functional components of an illustrative electronic device 200. The electronic device 200 has a processor 260, a memory 262, a display 228, and a user interface 232. The memory 262 generally includes both volatile memory (e.g., RAM) and non-volatile memory (e.g., ROM, Flash Memory, or the like). The electronic device 200 includes an operating system 264, such as the Windows CE operating system from Microsoft Corporation or another operating system, which is resident in the memory 262 and executes on the processor 260. The user interface 232 may be a series of push buttons, a scroll wheel, a numeric dialing pad (such as on a typical telephone), or another type of user interface means. The display 228 may be a liquid crystal display, a multiple bit display, or a full color display or any other type of display commonly used in electronic devices. In one example, the display 228 may be touch-sensitive that would act as an input device.

One or more application programs 266 are loaded into memory 262 and run on the operating system 264. Examples of application programs include phone dialer programs, email programs, scheduling/calendaring programs, PIM (personal information management) programs, Internet browser programs, and so forth. The electronic device 200 also includes a non-volatile storage 268 that is located within the memory 262. The non-volatile storage 268 may be used to store persistent information which should not be lost if the electronic device 200 is powered down. The applications 266 may use and store information in the storage 268, such as e-mail or other messages used by an e-mail application, contact information used by a PIM, appointment information used by a scheduling program, documents used by a word processing application, and the like.

The electronic device 200 has a power supply 270, which may be implemented as one or more batteries. The power supply 270 might further include an external power source, such as an AC adapter or a powered docking cradle that supplements or recharges the batteries.

The electronic device 200 is also shown with two types of external notification mechanisms: an LED 240 and an audio interface 274. These devices may be directly coupled to the power supply 270 so that when activated, they remain on for a duration dictated by the notification mechanism even though the processor 260 and other components might shut down to conserve battery power. The LED 240 may be programmed to remain on indefinitely until the user takes action to indicate the powered-on status of the device. The audio interface 274 is used to provide audible signals to and receive audible signals from the user. For example, the audio interface 274 may be coupled to a speaker for providing audible output and to a microphone for receiving audible input, such as to facilitate a telephone conversation, or as a user interface using voice recognition. In another example, a vibration device (not shown) can be used to give feedback to the user such as for alerting the user of a newly arrived message. The electronic device 200 can control each alert mechanism separately (e.g., audio, vibration, as well as visual cues).

The electronic device 200 also includes a radio interface layer 272 that performs the function of receiving and/or transmitting radio frequency communications. The radio interface layer 272 facilitates wireless connectivity between the electronic device 200 and the outside world, via a communications carrier or service provider. Transmissions to and from the radio interface layer 272 are conducted under control of the operating system 264. In other words, communications received by the radio interface layer 272 may be disseminated to application programs 266 via the operating system 264, and vice versa.

In one example of the present invention, electronic device 200 is a mobile electronic device such as a watch device that includes a wireless interface. An exemplary user interface for a watch device is shown in FIG. 3A, as will be described below. Although the below-described user interface configurations include multiple selector buttons (e.g., four selector buttons), the functions of many of the selector buttons may be combined by a single selector (e.g., a button, a rocket switch, a wheel, etc.).

User Interface (UI)

Figure 3:
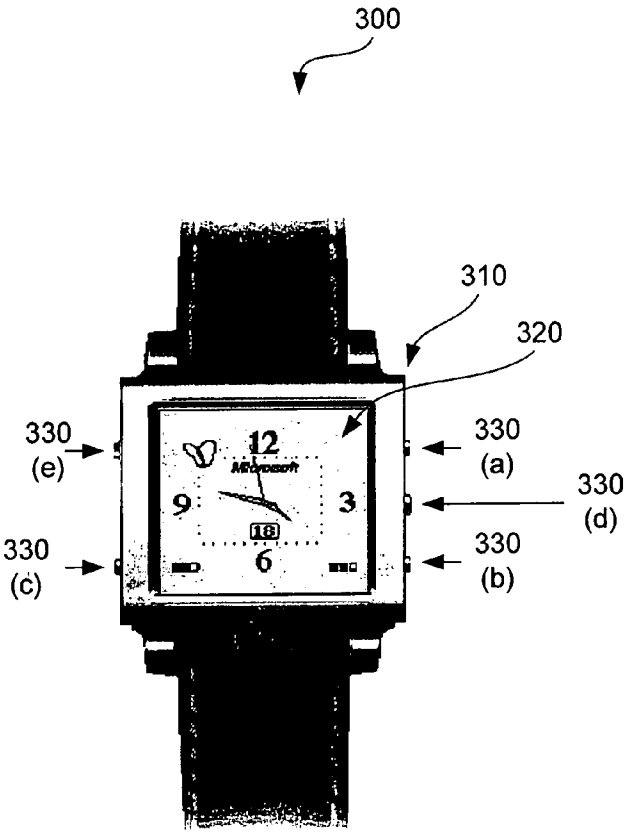
FIG. 3 depicts a watch device that includes a user interface.

FIG. 3 illustrates an exemplary watch device 300 that includes a user interface that is configured to take advantage of glanceable information technology. The watch device 300 includes a bezel 310, which has an electronic system (e.g., see FIG. 2). The electronic system performs the functions in a manner that is consistent with the hardware that was previously described with respect to FIG. 2. The bezel 310 has a display 320 such as a liquid crystal display, a multiple bit display, or a full color display. In one embodiment, watch hands are electronically generated on the display 320. In an alternative embodiment, the bezel includes analog-type watch hands that do not detrimentally interfere with the display 320. The watch device 300 includes a series of buttons 330(*a*)–(*e*) that are arranged to operate as a user interface (UI).

Each of the buttons operates as a selector in the user interface. Every button has a default function, and/or a context determined function. The currently selected channel determines the context for each selector. Alternatively, the currently active display may determine the context for each selector. For example, a display screen (e.g., a help screen) may be superimposed on the main display such that the display screen becomes the active context. The electronic device 300 is context sensitive in that the function that is associated with each selector may change based on the selected channel or display screen.

Antenna System for a Mobile Electronic Device

The present invention provides an antenna system for an electronic device. More particularly, the present invention provides an antenna system for a mobile electronic device, such as a watch, for improving reception of high, very-high, and ultra-high frequency signals by the device. According to a preferred embodiment, the antenna system includes first and second antennas wired in parallel with one another in the antenna circuit. The parallel antenna structure results in an equivalent circuit having a reduced inductance without substantially affecting the induced voltage for the equivalent circuit. The antenna system tends to allow higher inductance and radiation resistance for each antenna, while allowing manageable capacitance values for antenna tuning. In the described embodiments, the electronic devices may be smart watch type devices that are specially configured to receive and/or transmit communication signals.

The following discussion relates to an antenna system for watch devices and similar electronic systems. However, it will be appreciated that the present invention is not limited to watch devices, and those skilled in the art will realize the benefits of the present invention for other mobile and portable electronic devices.

Figure 4:
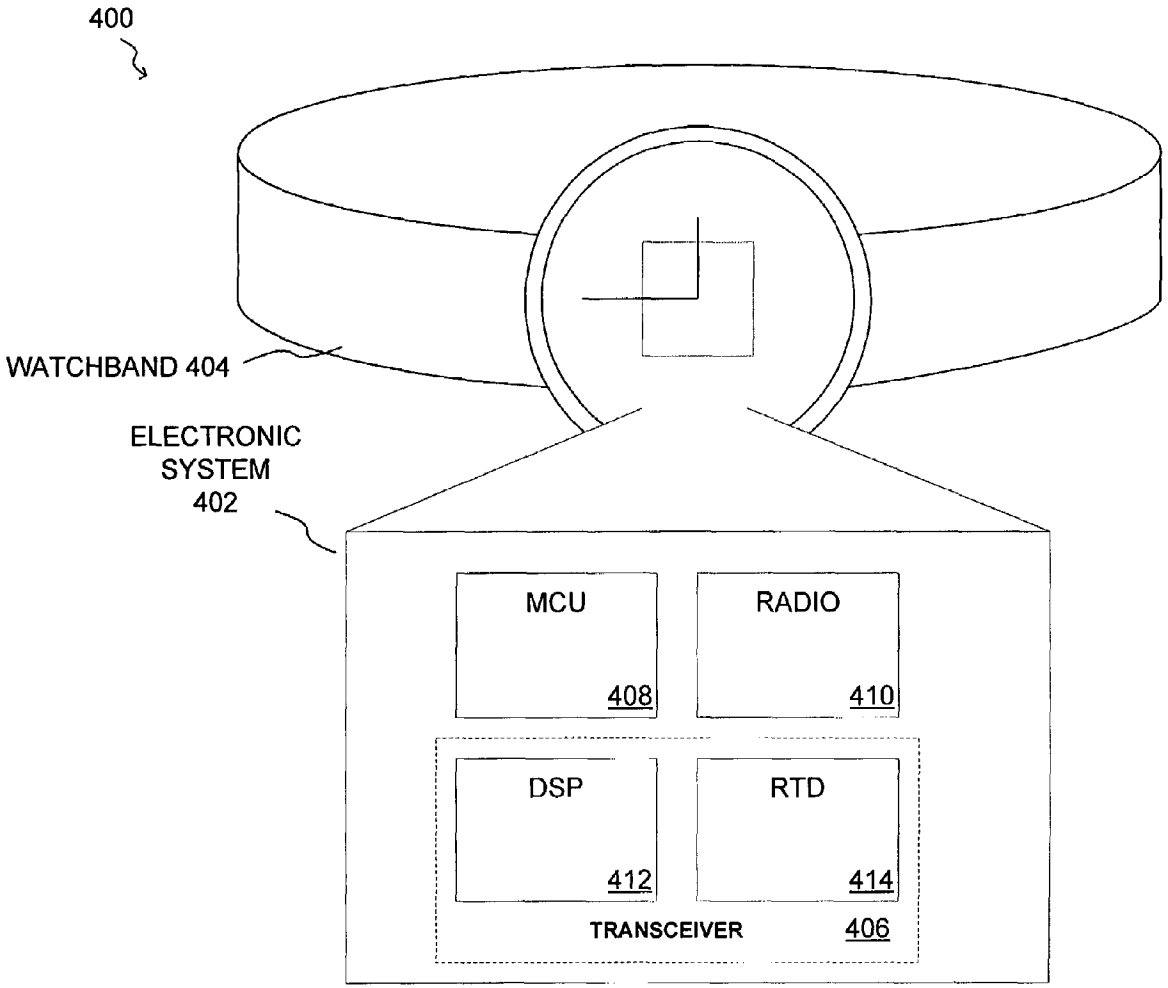
FIG. 4 depicts another watch device and related components.

An exemplary watch device 400 is shown in FIG. 4. The watch device 400 includes an electronic system 402 that is configured to operate in accordance with the present invention. The electronic system 402 may be contained in the bezel as shown in FIG. 4, or in some other portion of the watch device. The watch device 400 also may include a watchband 404 for attaching the watch to a user's wrist.

The electronic system 402 is a computer-based system, including functionality of operating as either a receiver and/or transceiver type of device. As illustrated in the figure, the electronic system includes a transceiver 406, a microcomputer unit or microprocessor 408, and an analog radio 410. As will be described in detail below, an antenna is connected to the transceiver 406 for emitting and/or receiving information signals. Transactions between the microprocessor 408 and the radio components are mediated over a microprocessor-digital transceiver interface. The components of the watch device 400 are housed in a watch-sized enclosure and rely on battery power for operation.

The transceiver 406 generally includes a digital signal processor (DSP) 412, which performs control, scheduling, and post-processing tasks for the transceiver, and a real-time device (RTD) 414, which includes a digital radio, system timing, and real-time event dispatching. The DSP 412 is coupled to the microprocessor 408, and transceiver tasks are commanded by the microprocessor 408.

One of the DSP's tasks may process received data for such purposes as sub-carrier phase recovery, baud recovery and/or tracking, compensation for fading effects, demodulation, de-interleaving, channel state estimation and/or error-correction. The post-processing of packets may occur when an entire packet has been received, or another subsequent time. The DSP 412 analyzes the transmitted data packets to determine a broadcast station's signal timing with respect to the local clock of the RTD 414. The local clock is synchronized with the transmitter's clock signal to maintain signal sampling integrity. The receiver is periodically brought into symbol synchronization with the transmitter to minimize misreading of the received data.

The digital section of the RTD 414 may include system time-base generators, such as a crystal oscillator that provides the system clock for the microprocessor 408 and the DSP 412. The time-base also provides baud and sample timing for transmit and receive operations, start/stop control for radio operation, and controls the periods of clock suspension to the microprocessor 408 and the DSP 412. The RTD 414 also performs radio operations, and may perform additional operations as well. The radio 410 is arranged to receive segments of data that is arranged in packets.

Figure 5A:
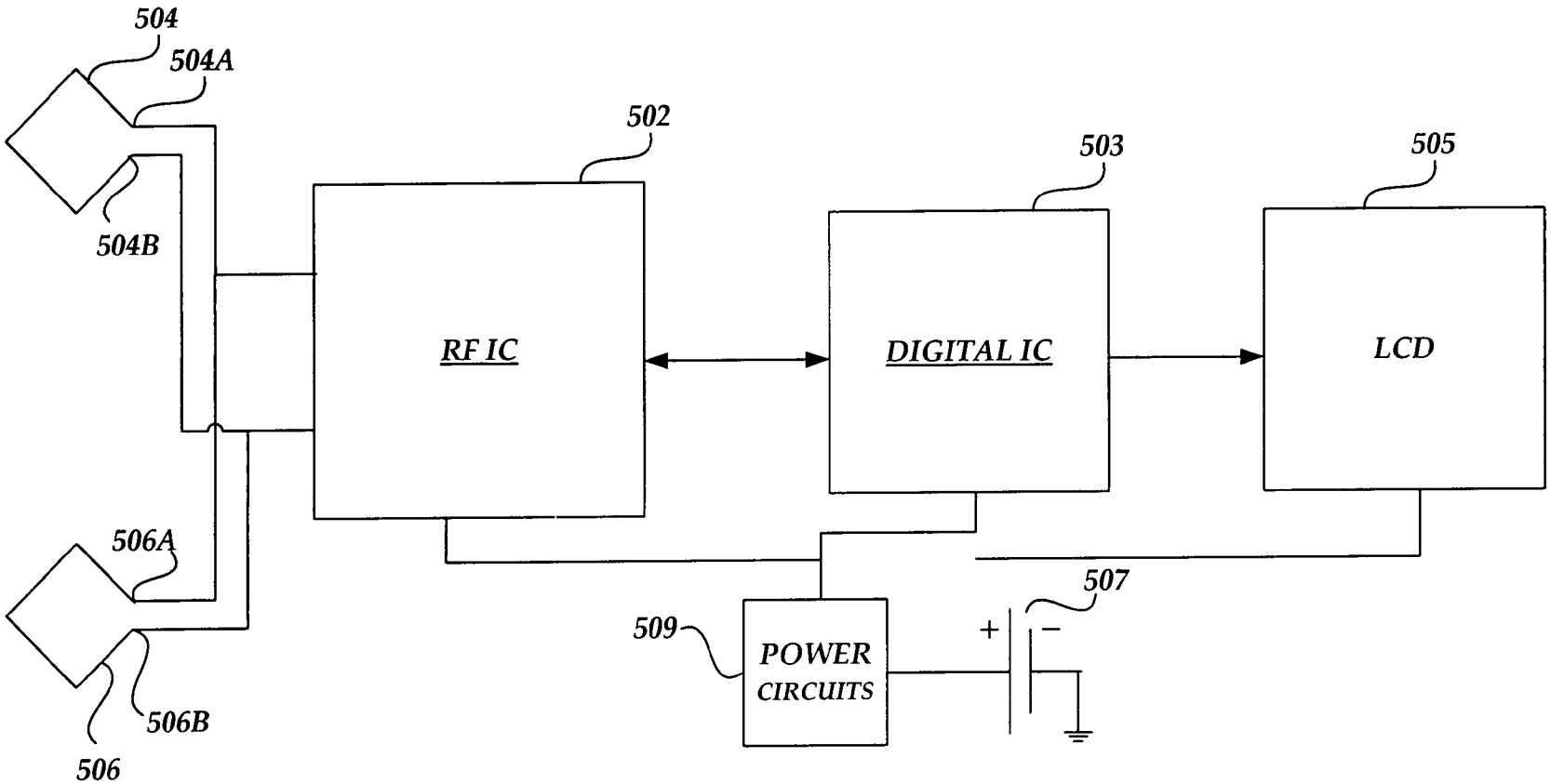
FIG. 5A is a functional block diagram of a mobile electronic device coupled to an antenna system according to an embodiment of the invention.
Figure 5B:
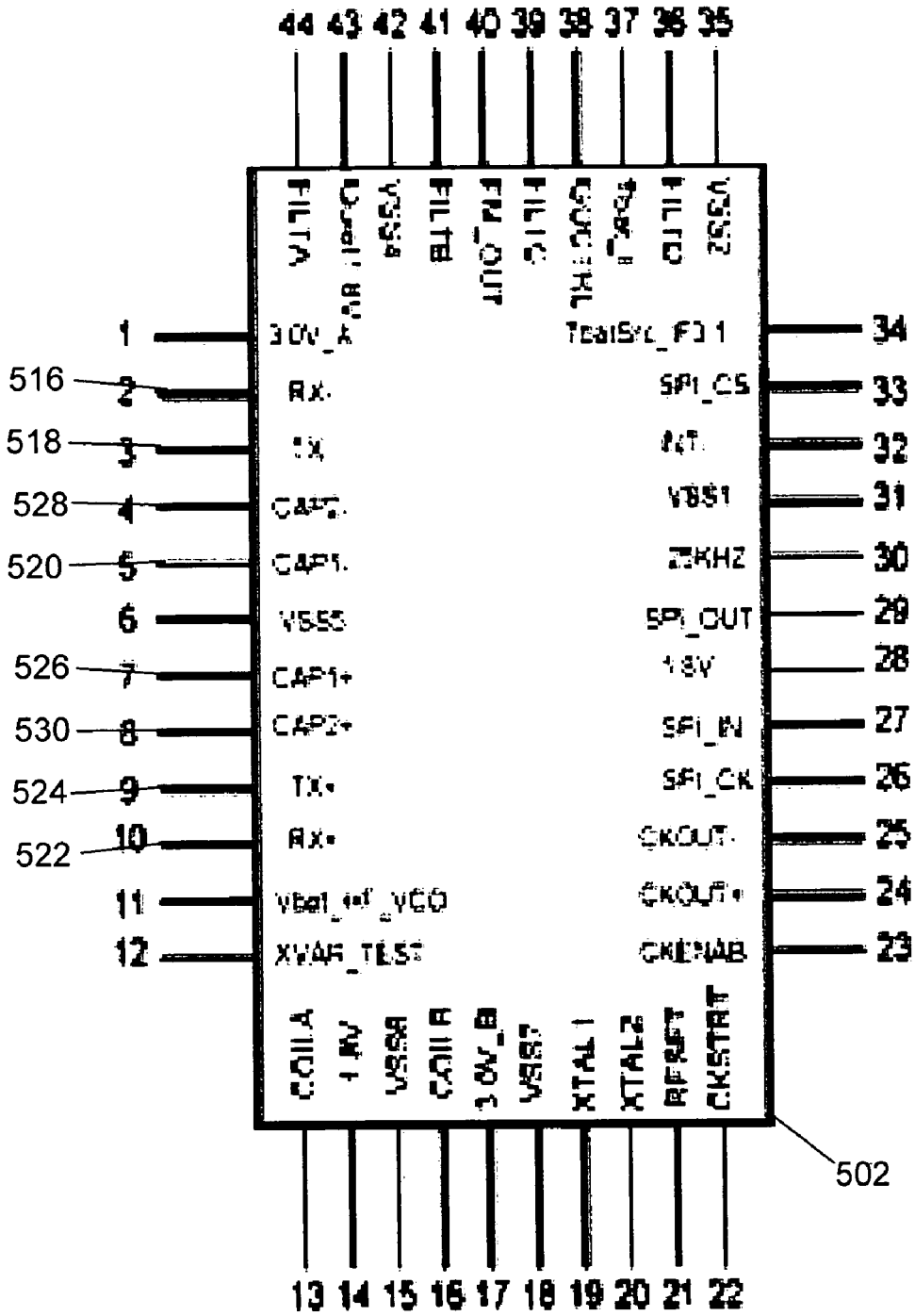
FIG. 5B illustrates a pin layout for an RF transceiver.
Figure 5C:
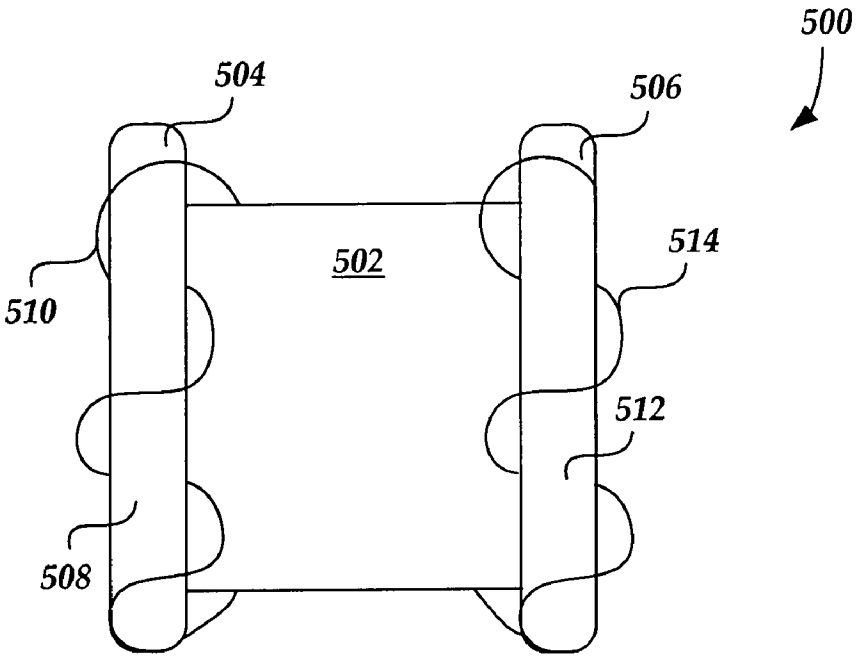
FIG. 5C depicts an antenna system according to an embodiment of the invention.

With reference now to FIGS. 5A–5C, an antenna system 500 according to a preferred embodiment of the invention is shown electrically connected to a transceiver 502 (RF IC), such as the transceiver 406 described in conjunction with the watch device 400 of FIG. 4. The transceiver 502, according to this embodiment, includes analog signal processing capabilities, an oscillator, a phase-locked loop (PLL), an ADC, and provides antenna tuning control. As shown in FIG. 5A, the transceiver is in communication with a digital IC 503. The digital IC 503 includes a processor, memory, digital multipliers and filters. The digital IC 503 is in communication with a display 505, such as an LCD. A power source 507 provides power to the device via power circuits 509. The RFIC 502 is operable to tune the antennas as a resonant tank circuit and provides amplification, mixing, and analog to digital conversion. The digital IC 503 is operable to provide digital signal processing and system level timing and control and the user I/O.

The antenna system 500 has an associated antenna pattern including a boresight and one or more nulls, and an antenna gain of about −25 dBi at about 100 MHz. This gain includes the antenna directivity and efficiency. It will be appreciated that specific gain values change with the operating frequency of the watch device. The watch device is operable to auto-tune for each case and includes forward error calculation algorithms for processing data when an antenna null is directed toward the information source. It will also be appreciated that the antenna system described herein is also applicable to transmit only and receive only applications.

With continuing reference to FIG. 5A, the antenna system 500 includes first and second antennas 504 and 506, which are electrically connected to one another in parallel. According to a preferred embodiment, one end 504*a*, 506*a* of each antenna (using a copper foil spiral for example) is attached to one end of a copper trace (two ends soldered together on a trace may be described as a "terminal") of the transceiver circuitry. As described below, and with reference to FIG. 5B, according to one embodiment of the invention, the other end of the copper trace is attached to the chip pins 522, 524, and 526 (RX+,TX+,CAP1+). In similar fashion, the other end 504*b*, 506*b* of each antenna is attached to another copper trace of the transceiver circuitry. The other end of the copper trace is attached to chip pins 516, 518, and 520 (RX−, TX−, CAP1−).

In one embodiment, one terminal of the parallel antenna combination is connected to chip pins 516, 518, and 520 (RX−,TX−,CAP1−) the other terminal of the parallel antenna combination is attached to chip pins 522, 524, and 526 (RX+,TX+,CAP1+) (see FIG. 5B). In an alternative embodiment, the CAP2 bank may be used by connecting one terminal of the parallel antenna combination to chip pins 516, 518, and 528 (RX−,TX−,CAP2−) the other terminal of the parallel antenna combination is attached to chip pins 522, 524, and 530 (RX+,TX+,CAP2+). In yet another alternative embodiment, both the CAP1 bank and the CAP2 bank may be used by connecting one terminal of the parallel antenna combination to chip pins 516, 518, 520, and 528 (RX−,TR−,CAP1−,CAP2−) the other terminal of the parallel antenna combination is attached to chip pins 522, 524, 526, and 530 (RX+,TX+,CAP1+,CAP2+).

The transceiver (RF IC) 502 is operable to adjust the capacitance from about 5 pf to about 35 pf based on the amount of inductance connected in parallel with a particular capacitance bank or banks. For example, when the CAP1 bank is connected, the amount of inductance may be about 94 nH to about 218 nH. When the CAP2 bank is connected, the amount of inductance may be about 94 nH to about 218 nH. If both CAP1 and CAP2 are connected, the amount of inductance may be about 47 nH to about 109 nH. Thus, the CAP1 bank, CAP2 bank, or both may be implemented as part of the antenna system based on the particular mobile electronic device and its related applications.

Figure 11:
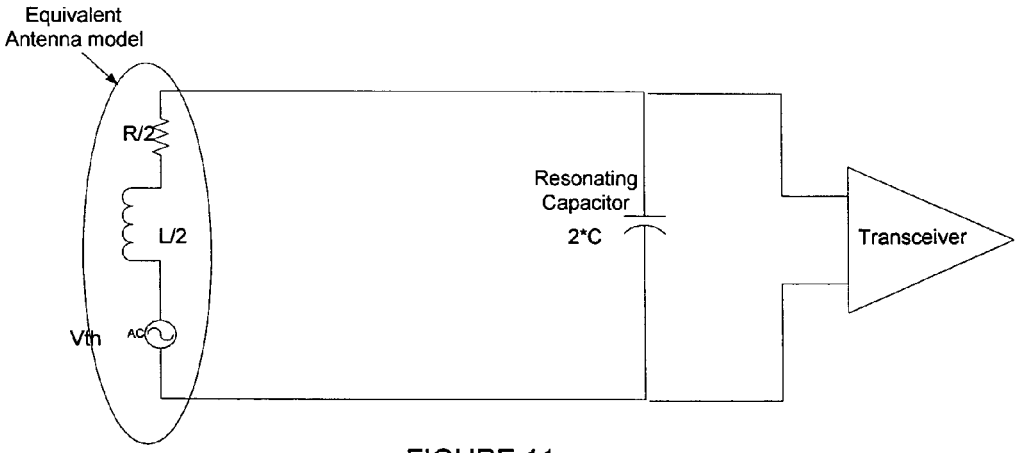
FIG. 11 illustrates an equivalent antenna circuit, a resonating capacitance, and a transceiver.

According to a preferred embodiment, the first antenna 504 is about 40 mm in length and has a diameter of about 8 mm. According to this embodiment, as shown in FIG. 5C, the first antenna 504 includes a ferrite rod 508 wrapped with copper tape 510, forming a number of loops about the rod, which define a planar spiral winding configuration. The second antenna 506 is also about 40 mm in length and includes a diameter of about 8 mm. The second antenna 506 also preferably includes a ferrite rod 512 wrapped with copper tape 514. Using a ferrite rod as part of each antenna may effectively increase the effective radiation resistance and radiation efficiency of each antenna. For this embodiment, each antenna includes a ferrite rod wrapped with copper tape, wherein the copper tape for each antenna has three windings. Furthermore, according to this embodiment, each winding is spaced about 3 mm from an adjacent winding about the respective ferrite rod and the tape is wound in the same direction about each respective rod (counter-clockwise for each antenna as shown in FIG. 11). However, those skilled in the art will appreciate that the copper tape may include fewer or greater turns depending upon the particular application and desired results thereof.

According to the present invention, the antenna system 500 tends to provide higher inductance and radiation resistance for each antenna 504 and 506, while allowing manageable capacitance values for antenna tuning. As described further below, the antenna system 500 results in an equivalent circuit having a reduced inductance without substantially affecting the induced voltage for the equivalent circuit.

The antenna system's radio reception capability may be enhanced by resonating the antenna system 500 with capacitance in parallel with the system 500. The capacitance resonates or eliminates the reactive (inductance) component of the antennas so that the received signal voltage is not appearing mainly across an inductor and thereby not becoming wholly unusable by the transceiver. Preferably, the transceiver 502 includes one or more capacitance banks, as described above (see FIG. 5B, capacitance banks CAP1, CAP2). According to the preferred embodiment of the invention, the capacitance banks CAP1 and/or CAP2 are connected in parallel to the first and second antennas 504 and 506, respectively. The transceiver 502 is operative to automatically adjust the capacitance based on the inductance of the first and second antennas, i.e. the first and second antennas and CAP1 and/or CAP2 form an oscillator and the transceiver 502 utilizes a binary stepping pattern to adjust the amount of capacitance until the correct frequency is found.

Antennas 504 and 506 of the antenna system 500 may be described as loop antennas, each having a high permeability core, such as ferrite, contained within the copper tape windings. However, according to an alternative embodiment, each antenna may include a wound conductor having a number of turns or windings without an internal rod or core. For electrically small loop antennas (diameter of loop <<wavelength), the voltage induced across the terminals of an open circuit antenna are small compared to noise voltages. In some applications, a tank circuit may be used to increase the amount of induced voltage. A tank circuit is a parallel resonant circuit including an inductor, capacitor, and an optional resistor.

Further increase in voltage or electromotive force (EMF) (V or EMF=N*(dPHI/dt); where PHI is the amount of flux and N is the number of turns) may be obtained by using loops with multiple turns. However, a trade off of number of turns (N) vs. loss due to: conductor loss, dielectric loss of any insulator, proximity loss of adjacent conductors, etc. must be considered when designing the antenna system. Another method to increase the flux density for a given magnetic field ("H" field) is to insert material with a higher permeability ($u_r$) inside the loop antenna. At FM frequencies (about 85 to 108 MHz) and higher, any high $u_r$ material loss must be also considered.

As described above, a ferrite rod is used as the antenna core for each antenna 504, 506 of the antenna system 500, according to a preferred embodiment of the invention. However, other high permeability materials may be used as well and the invention is not intended to be limited by any examples or embodiments described herein. Furthermore, when using ferrite or other high permeability material rods as the antenna core, the flux density may be enhanced by extending the ends of the rod beyond the outermost edges of the conductor windings. The "extra" loss due to more windings may be substantially eliminated by extending the ends of the rod beyond the edge of the conductor windings.

As described above in accordance with the invention, it is possible to reduce the inductance of the equivalent circuit while maintaining substantially the same induced voltage for the equivalent circuit by connecting more than one loop antenna in parallel with a resonating capacitance. This becomes particularly desirable for mobile electronic devices, such as smart watches for example, given the size constraints ("form factor") of these devices. Furthermore, the loss resistance of the equivalent circuit is also reduced.

Figure 6:
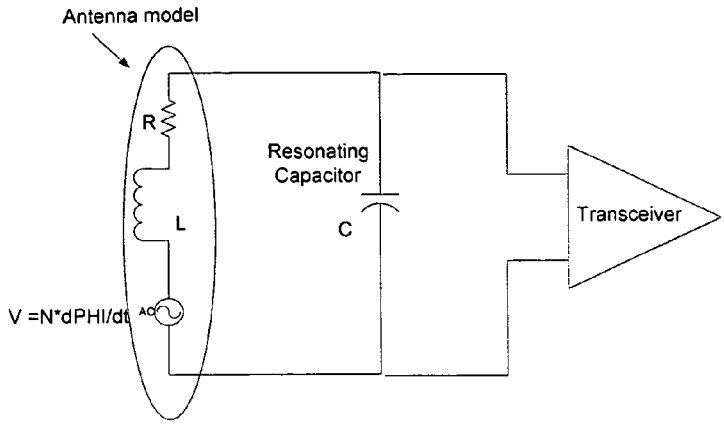
FIG. 6 depicts a circuit model for a single loop antenna.
Figure 7:
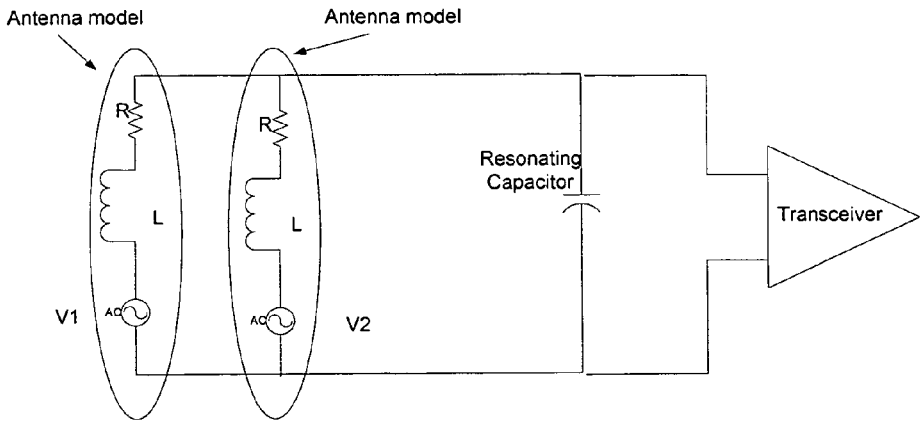
FIG. 7 depicts a circuit model for two loop antennas connected in parallel.

A circuit model for a single loop antenna is shown in FIG. 6. The symbol R represents the conductor and insulator loss and the radiation resistance. V represents the voltage induced by a magnetic field (V=N*(dPHI/dt)). A circuit model for two loop antennas connected in parallel is shown in FIG. 7. Note that because the loop antennas are electrically small, V1 and V2 are assumed in phase and equal in amplitude (for substantially identical loop antennas wound in the same direction). Also, the R and inductance (L) are equal for each loop antenna in this example of substantially identical loop antennas.

Figure 8:
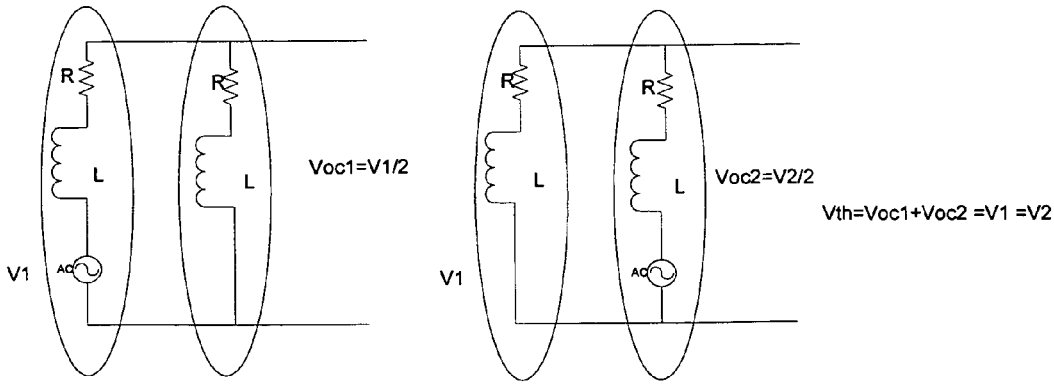
FIG. 8 illustrates a circuit analysis for determining the Thevenin equivalent voltage ($V_{th}$) for the circuit model of FIG. 7.
Figure 9:
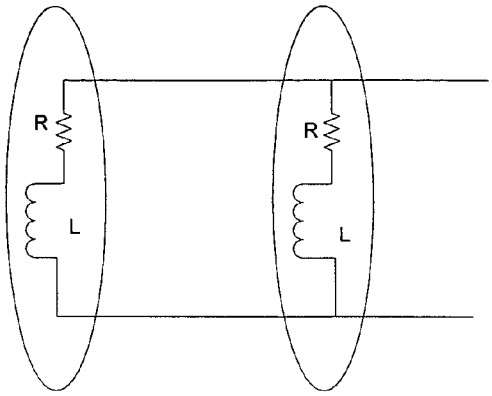
FIG. 9 illustrates a circuit analysis for determining the Thevenin equivalent source impedance for the circuit model of FIG. 7.

As described above in reference to the embodiment shown in FIG. 6, the first and second antennas 504, 506 of the antenna system 500 are spaced apart at a distance that tends to reduce the mutual inductance to a negligible amount. The separation is preferably about the diameter or width of the ferrite rods, about 8 mm to about 10 mm for this example, in cases where each rod includes multiple conductor winding or turns (such as copper tape windings described above). Superposition is used to obtain the Thevenin equivalent circuit. FIG. 8 illustrates the circuit analysis for determining the Thevenin equivalent voltage ($V_{th}$) for the circuit model of FIG. 7. FIG. 9 illustrates the circuit analysis for determining the Thevenin equivalent source impedance $Z_o$, (where S is defined as the Laplace transform variable used to define reactive component impedances and circuit excitation and response as a function of frequency) for the circuit model of FIG. 7.

Figure 10:
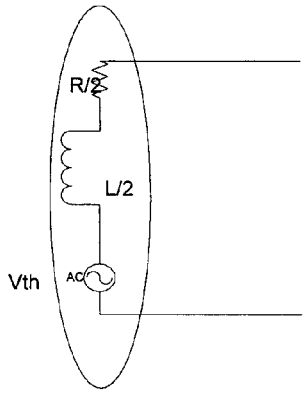
FIG. 10 illustrates a final Thevenin equivalent circuit for circuit model of FIG. 7.

FIG. 10 illustrates the final Thevenin equivalent circuit for the two antennas connected in parallel. It is important to note that the inductance L of a single antenna is now L/2 in the equivalent circuit for two parallel antennas of the antenna system. The lower inductance enables the implementation of a larger capacitance (2*C for this example) for resonating the tank circuit. Therefore, the limit on the tank circuit due to parasitic capacitance is substantially relieved. Also note that the R is now R/2 in the equivalent circuit, but the $V_{th}$ voltage is still the same as in the single antenna case of FIG. 6.

FIG. 11 illustrates the equivalent antenna circuit, the resonating capacitance, and the transceiver. As the transceiver input resistance or the equivalent parallel loss resistance of the capacitance become on the order of the equivalent parallel resistance for the antenna system, then the voltage across the receiver input terminals increases with the parallel antennas.

As an example, for cases where the input resistance of the transceiver is high (e.g. 10 Mohm), the parallel antenna system has a resonant current of Vth/2R. This resonant current flows through capacitive reactance of 1/jw2*C) (see FIG. 11). For the single antenna case the resonant current is Vth/4R that flows through the capacitive reactance of 1/(jw*C). Because the reactance is lower (½) for parallel antenna tuned at proper frequency and the resonating current is higher (×2) the voltage across the capacitor (and receiver input) is the same for single or parallel antenna. But if the transceiver input resistance is lower (e.g. 6 kohm) then some of the resonating current flows through the input resistance and the effect of changing the resonating capacitor is less. This increased voltage improves sensitivity as well as the original purpose of increasing radiation resistance according to the preferred embodiment by using multiple turns and a ferrite material core for each antenna.

Figure 12:
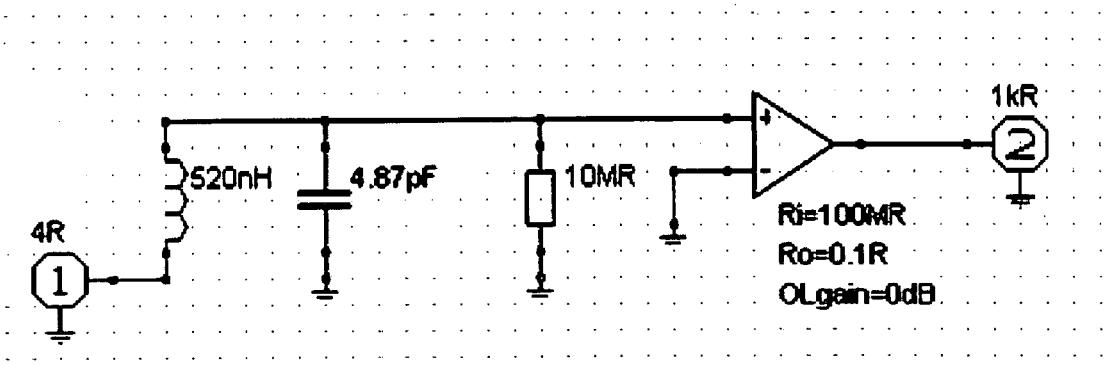
FIGS. 12 and 13 illustrate a simulation of a single antenna.
Figure 13:
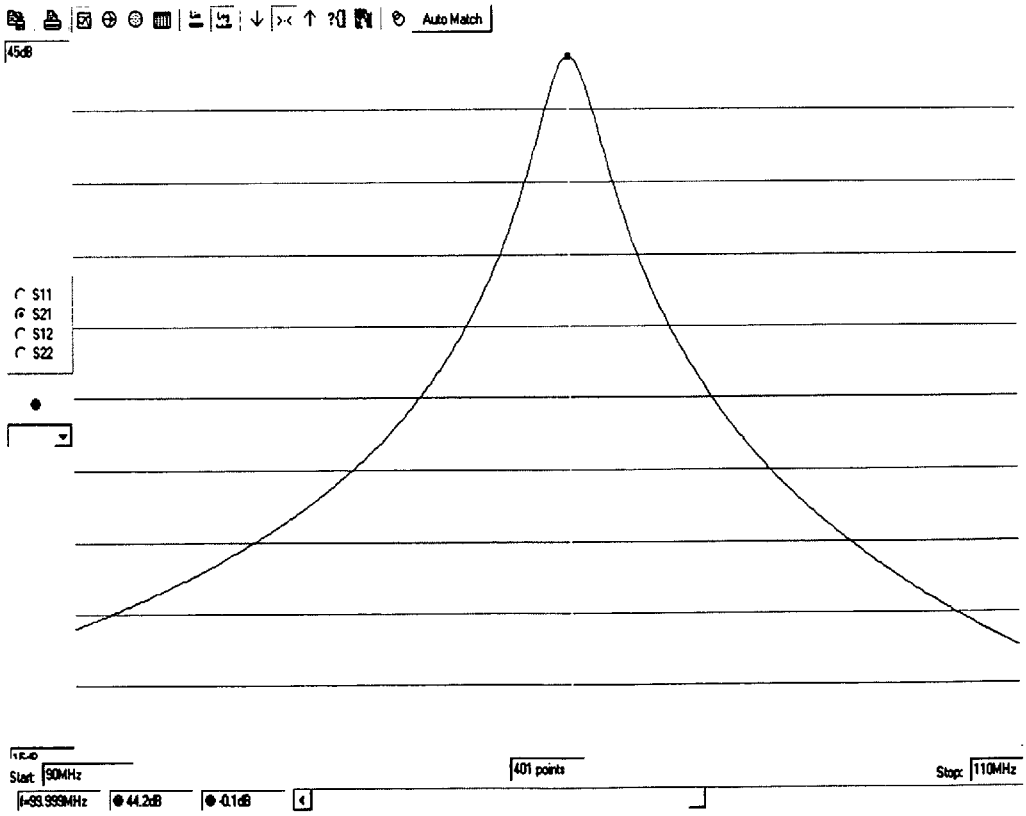
Figure 14:
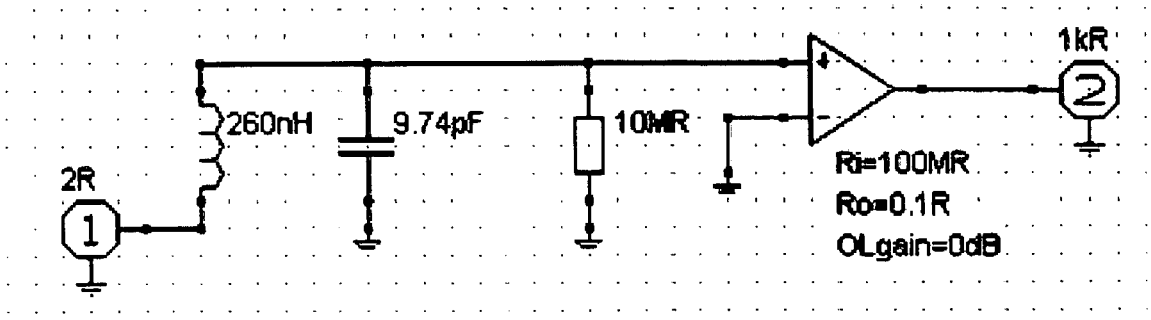
FIGS. 14 and 15 illustrate a simulation for two antennas connected in parallel and resonated at the same frequency.
Figure 15:
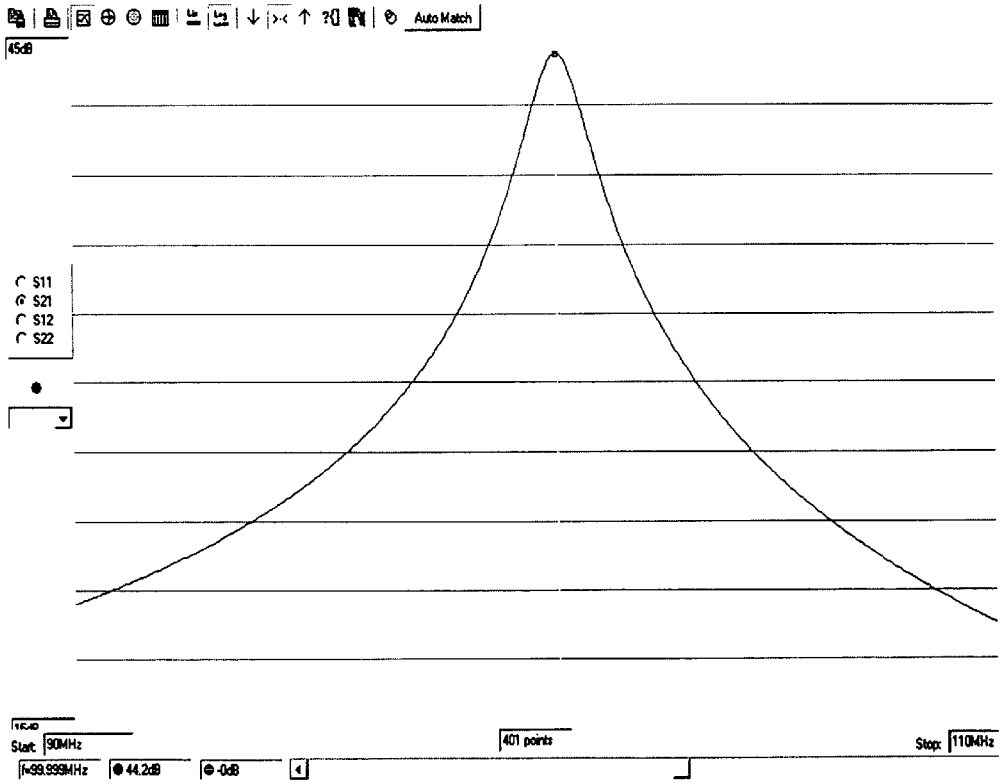

FIGS. 12–15 depict examples with respect to a transceiver having a 10 Mohm input resistance. FIGS. 12 and 13 illustrate a simulation of a single antenna. FIGS. 14 and 15 illustrate a simulation for two antennas connected in parallel and resonated at the same frequency.

Experimental results:

Tables 1 and 2 below provide comparison data between a single antenna and a two parallel antenna system. The single antenna was made of 3 turns of 10 mm wide copper tape wound around a 40 mm×8 mm ferrite rod. The ferrite rod was Material 67 manufactured by FAIR-RITE. The copper tape was 3M PN1194 which has thickness of 0.0014 inches. A prototype similar to the antenna system shown in FIG. 5A was assembled to test the two parallel antenna system. Tests with two parallel antennas were made using the same tape and ferrite material as in the single antenna case, but the ferrite rods used were 45 mm×8 mm. The slight increase in length was negligible to the overall result. The single antenna was connected to a watch module including an RF transceiver that receives data on an FM subcarrier. Similarly, two parallel antennas were connected to a watch module including an RF transceiver that receives data on an FM subcarrier. The same watch module was used in both cases and the tests were made in a Gigahertz Transverse Electromagnetic Module (GTEM) to allow approximately 0.5 dB repeatability.

TABLE 1

| Field strength (dBuV/m) | Single antenna, 3 turns on 1 ferrite rod Block Error Rate % | Two antennas connected in parallel, each having 3 turns on 1 ferrite rod, Block Error Rate % |
|---|---|---|
| 56 | 62% | 0% |
| 55 | 94% | 0% |
| . . . | | |
| 51 | 100% | 1.4% |
| 50 | 100% | 18% |
| 49 | 100% | 76% |

TABLE 2

| Field strength (dBuV/m) | Single antenna, 3 turns on 1 ferrite rod Block Error Rate % | Two antennas, each having 3 turns on 1 ferrite rod, Block Error Rate % |
|---|---|---|
| 53 | 24% | 0% |
| 52 | 76% | 0% |
| . . . | | |
| 49 | 100% | 0.6% |
| 48 | 100% | 12% |
| 47 | 100% | 33% |
| 46 | 100% | 93% |

The data shows a 6 to 7 dB improvement using the antenna system with two antennas connected in parallel as compared to the single antenna implementation. As shown in Table 1, at 88.9 MHz, the single antenna has 62% block-error-rate (BLER) at 56 dBuV/m while the parallel antennas have a 76% BLER at 49 dBuV/m (a 7 dB improvement). As shown in Table 2, at 98.7 MHz the single antenna has 24% BLER at 53 dBuV/m while the parallel antennas have a BLER (33%) at 47 dBuV/m (a 6 dB improvement).

According to the invention, an improved antenna system for a mobile electronic device is provided for receiving a linear polarized field including at least two antennas which are connected in parallel and coupled to an FM transceiver. It will be appreciated that the antenna windings described above may have a different shape, such as rectangular, etc. An alternative embodiment of the invention includes the use of four antennas connected in parallel. Furthermore, multiple antennas may be arranged to allow a more "omni" directional antenna pattern. By arranging the antennas so a "null" of one antenna field pattern coincides with a peak of the other antenna field radiation pattern, may operate to overcome issues with the null found in a loop antenna. Also one could reverse the winding polarity on one or more of the antennas in the system and shape the field pattern to meet specific goals such as low antenna gain in the direction of a noise source while maintaining high gain in other directions.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A mobile electronic device comprising:

a transceiver operative to transmit and receive modulated carrier wave signals within a frequency range, an antenna system coupled to the transceiver for emitting and receiving the signals, the antenna system including:

a first antenna connected to the transceiver, the first antenna having a length, a width, and a number of windings, each winding having a direction of rotation, a second antenna connected to the transceiver and spaced apart from the first antenna, the second antenna having a length, a width, and a number of turns, each winding having a direction of rotation, the second antenna being electrically connected to the first antenna defining a parallel antenna circuit configuration, and a microprocessor coupled to the transceiver for processing the signals.

2. The mobile electronic device of claim 1, wherein the parallel antenna circuit configuration defines an equivalent circuit having a reduced inductance with a substantially unaffected induced voltage for the equivalent circuit.

3. The mobile electronic device of claim 1, wherein the transceiver operates within a frequency modulated band.

4. The mobile electronic device of claim 3, wherein the transceiver has a receiving operational frequency range from about 87.6 MHz to about 107.9 MHz.

5. The mobile electronic device of claim 3, wherein the transceiver has a transmitting operational frequency range from about 85.3 MHz to about 108.7 MHz.

6. The mobile electronic device of claim 1, wherein the first and second antennas have about the same number of windings, wherein each winding of each antenna has the same direction of rotation.

7. The mobile electronic device of claim 1, wherein the first and second antennas each comprise a high permeability core wrapped with a conductor.

8. The mobile electronic device of claim 1, wherein the first and second antennas each comprise a conductor coil having an air core.

9. The mobile electronic device of claim 1, wherein the first and second antennas each comprise a conductor having a planar spiral configuration.

10. A mobile electronic device comprising:

a transceiver operative to transmit and receive encoded signals within a frequency range, antenna means coupled to the transceiver and configured to emit and receive the signals, wherein the antenna means defines an equivalent circuit having a reduced inductance with a substantially unaffected induced voltage for the equivalent circuit and the antenna means comprises at least two antennas electrically connected to one another to define a parallel antenna circuit configuration, and a microprocessor coupled to the transceiver for processing the signals.

11. The mobile electronic device of claim 10, wherein the antenna means comprises:

a first antenna connected to the transceiver, the first antenna having a length, a width, and a number of windings, each winding having a direction of rotation, and a second antenna connected to the transceiver and spaced apart from the first antenna at a distance that reduces a mutual inductance between the first and second antennas to a negligible amount, the second antenna having a length, a width, and a number of windings, each winding having a direction of rotation, the second antenna being electrically connected to the first antenna defining a parallel antenna circuit configuration.

12. The mobile electronic device of claim 11, wherein the first and second antennas have an equal number of windings, wherein each winding of each antenna has the same direction of rotation.

13. The mobile electronic device of claim 11, wherein the first and second antennas each comprise a high permeability core wrapped with a conductor.

14. The mobile electronic device of claim 11, wherein the first and second antennas each have about same length, width, and number of windings.

15. An antenna system for a mobile electronic device configured to emit and receive encoded signals, the antenna system comprising:

a first antenna having a length, a width, and a number of windings, each winding having a direction of rotation, and a second antenna spaced apart from and parallel to the first antenna, the second antenna having a length, a width, and a number of windings, each winding having a direction of rotation, the second antenna being electrically connected to the first antenna in parallel, the parallel antenna configuration defining an equivalent circuit having a reduced inductance with a substantially unaffected induced voltage for the equivalent circuit.

16. The antenna system of claim 15, wherein the first and second antennas are spaced apart from one another at a distance about equal to the width of the first antenna.

17. The antenna system of claim 15, wherein the first and second antennas have about the same number of windings, wherein each winding of each antenna has the same direction of rotation.

18. The antenna system of claim 15, wherein the first and second antennas each comprise a high permeability core wrapped with a conductor.

19. The antenna system of claim 15, wherein the first and second antennas each have about same length, width, and number of windings.

* * * * *